US007814602B2

(12) United States Patent
Stydahar

(10) Patent No.: US 7,814,602 B2
(45) Date of Patent: Oct. 19, 2010

(54) HAIRBRUSH

(75) Inventor: George Stydahar, Croton on Hudson, NY (US)

(73) Assignee: Stydahar & Associates, Inc., Croton on Hudson, NY (US)

( * ) Notice: Subject to any disclaimer, the term of this patent is extended or adjusted under 35 U.S.C. 154(b) by 1026 days.

(21) Appl. No.: 11/588,337

(22) Filed: Oct. 27, 2006

(65) Prior Publication Data

US 2008/0098541 A1 May 1, 2008

(51) Int. Cl.
*A47B 7/06* (2006.01)

(52) U.S. Cl. ..... 15/22.3; 15/22.1; 15/160; 15/201; 15/27; 15/172; 132/120; 132/148; 132/151

(58) Field of Classification Search ..... 15/22.3, 15/160, 201, 27, 172, 186; 132/120; *A45D 24/00, A45D 24/10; A46B 7/06, 3/70, 13/02*
See application file for complete search history.

(56) References Cited

U.S. PATENT DOCUMENTS 793,234 A * 6/1905 Scanlan ..... 15/22.3
866,019 A 9/1907 Handel
4,197,608 A * 4/1980 Holley et al. ..... 15/27
5,133,712 A 7/1992 McPherson
5,427,120 A * 6/1995 Wong ..... 132/120
5,502,860 A * 4/1996 Franke ..... 15/160
6,032,313 A * 3/2000 Tsang ..... 15/22.1
2008/0098541 A1 5/2008 Stydahar

FOREIGN PATENT DOCUMENTS

GB 2375038 A * 11/2002

* cited by examiner

*Primary Examiner*—Monica S Carter
*Assistant Examiner*—Stephanie Newton
(74) *Attorney, Agent, or Firm*—Baker & Hostetler LLP

(57) ABSTRACT

A hairbrush and method of brushing are provided in which tangled hair may be brushed out at a better rate and with less pain. The hairbrush includes bristles that are mounted on revolving track portions so that when the bristles encounter a tangle or a resistance in the hair, the bristles are free to rotate. The hairbrush further includes a thumb button to adjust the resistance of the revolving track portion from a freely rotating position to a fixed position.

16 Claims, 3 Drawing Sheets

HAIRBRUSH

FIELD OF THE INVENTION

The present invention relates generally to a hairbrush. More particularly, the present invention relates to a hairbrush having rotatable bristles.

BACKGROUND OF THE INVENTION

Conventional hairbrush comes in various sizes and shapes, including hairbrushes with bristles on all surfaces (round body) to hairbrushes with bristles on one side. A conventional hairbrush includes a handle portion attached to a body portion having bristles thereon. The bristles are fixed on the body portion and are used to untangle hair as it is brushed through the hair strands. The user moves the bristles through the hair strands until it reaches a tangle. When the tangle is reached, the user will pull hard on the tangle in hopes of untangling the hair. Alternatively, the user will reposition the hairbrush against the scalp and try to brush around the tangle to loosen the hair. The above described motions can result in pain and hair loss because the bristles move to a certain extent and thus do not have any give when encountering a tangle that is difficult to untangle on the first or second brushing.

Accordingly, it is desirable to have a brush that will untangle hair with considerable less pulling, hair loss and pain by having its bristles being more flexible when encountering a tangle.

SUMMARY OF THE INVENTION

The foregoing needs are met, to a great extent, by the present invention, wherein in one aspect an apparatus is provided that in some embodiments allows a set of bristles to rotate in a direction opposite a direction of brushing.

In accordance with one embodiment of the present invention, a hair brush that includes a handle portion to move the hair brush through hair, a body portion coupled to the handle portion and having revolving track portions that rotate on a set of tracks, a set of bristles coupled to the revolving track portions to brush hair, and a slidable button that adjusts a resistance that is applied to the tracks through a clutch assembly and thereby adjusts the rotation of the revolving track portions.

In accordance with another embodiment of the present invention, a method of brushing is provided and can include brushing a hair in a first direction with a hairbrush having a set of bristles coupled to revolving track portions, engaging a tangle portion of the hair with the bristles; and rotating the revolving track portions in a second direction when the bristles engage the tangle of hair portion.

In accordance with yet another embodiment of the present invention, a hairbrush is provided and can include a handle portion to move the hair brush through hair, a body portion coupled to the handle portion, wherein the body portion includes revolving track portions that rotates on a set of tracks and non-revolving portion, a set of bristles coupled to the revolving track portion to brush hair, and a slidable button that adjusts a rotation of the revolving track portion through a clutch assembly.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
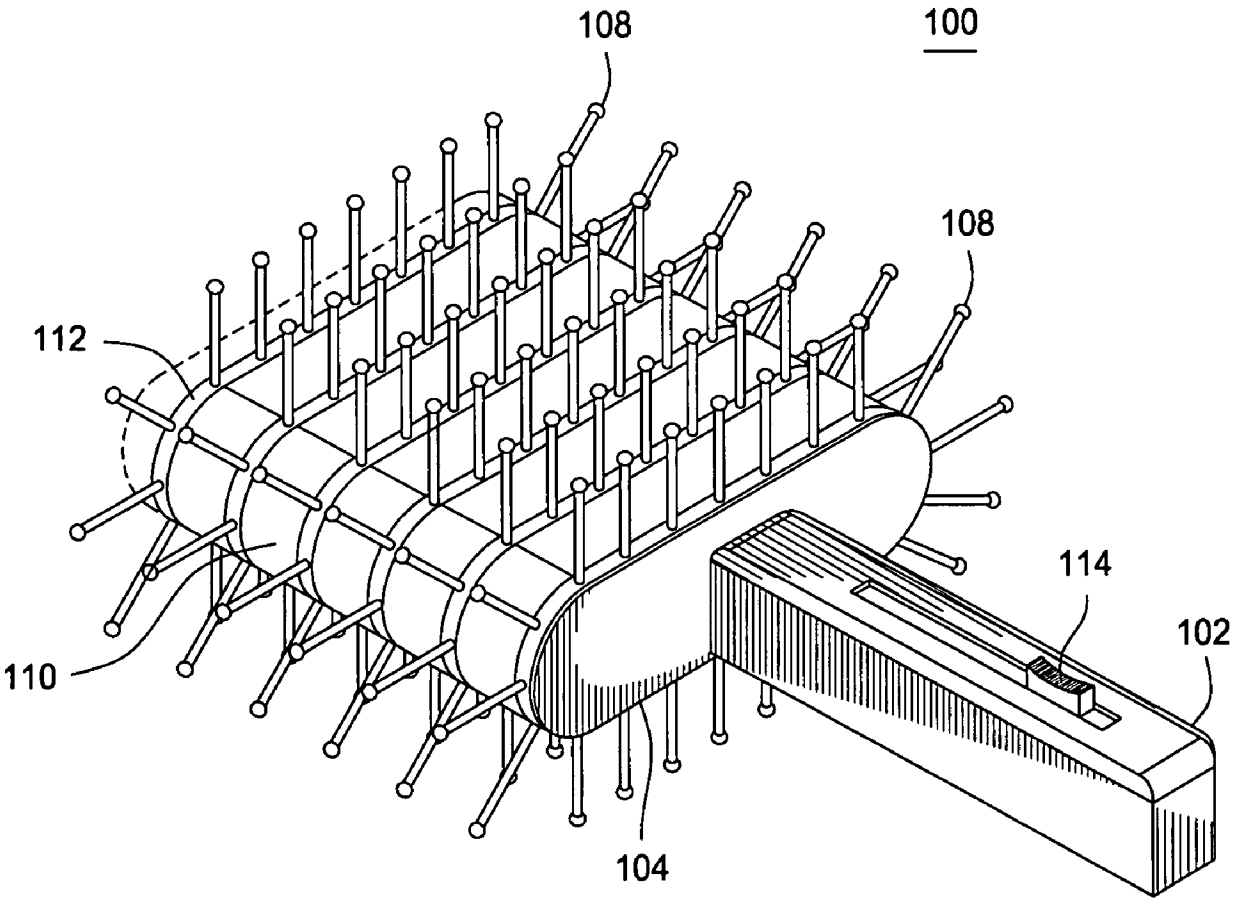
FIG. 1 is a perspective of a hair brush according to an embodiment of the invention.

The invention will now be described with reference to the drawing figures, in which like reference numerals refer to like parts throughout. An embodiment in accordance with the present invention provides an apparatus and method to brush hair more quickly, with less pull, pain or hair loss than conventional hair brush.

FIG. 1 is a perspective of a hair brush 100 according to an embodiment of the invention. The hair brush 100 includes a handle portion 102 coupled to a body portion 104. The handle portion 102 is designed to be gripped by a hand and is used to maneuver the hair brush through the hair. The handle portion 102 can be made of any material including natural (wood) and synthetic (polymer, resin, etc.). The handle portion 102, however, should not bend as the user brushes through the hair. Additionally, the handle portion 102 and the body portion can be integrally manufactured or can be coupled together. The handle portion 102 includes an adjustable thumb button 114 on a top surface. A person skilled in the art would recognize that the thumb button 114 can be on any surface of the handle portion 102. The thumb button 114 is designed to receive a thumb or any other parts of the hand and is slidable in a first and a second direction depending on the resistance desired on a revolving track portion having mounted bristle (discussed below).

The body portion 104 includes t revolving track portion 112 and a non-revolving portion 110. The non-revolving portion 110 does not rotate on tracks but remain stationary. Additionally, the non-revolving portion 110 may or may not include bristles thereon. The revolving track portion 112 is constructed and arranged to rotate on tracks 106 (See FIG. 2). In one embodiment, the track may have grooves on its surface to receive the revolving track portion 112 and help to keep the revolving track portion 112 on the track during use. The revolving track portion 112 may be provided the entire length of the body portion. However, the number of revolving track portion 112 can vary and thus the revolving track portion 112 may be the entire length of the body portion or only on certain parts of the body portion. The revolving track portion 112 rotates in one direction or in both directions depending on the needs of the user (such as left-handed and right-handed). The revolving track portion 112 can rotate in conjunction with each other, or independent of each other. The revolving track portion 112 includes thereon a set of bristles 108. In one embodiment, the bristles are attached to the revolving track portion 112 instead of being attached to the non-revolving portion 110.

The number of bristles on the revolving track portion 112 can vary depending on the hair of the user and other factors. The bristles can be made of various materials such as animal products (boar, etc.) or synthetic materials such as plastic, nylon or other polymers. Additionally, the spacing between the individual bristles varies depending on the needs of the user. The bristles can be positioned perpendicular to the revolving track portion 112 or at any other angle desired. The bristles can be integrated with the revolving track portion 112 or be coupled thereto.

Figure 2:
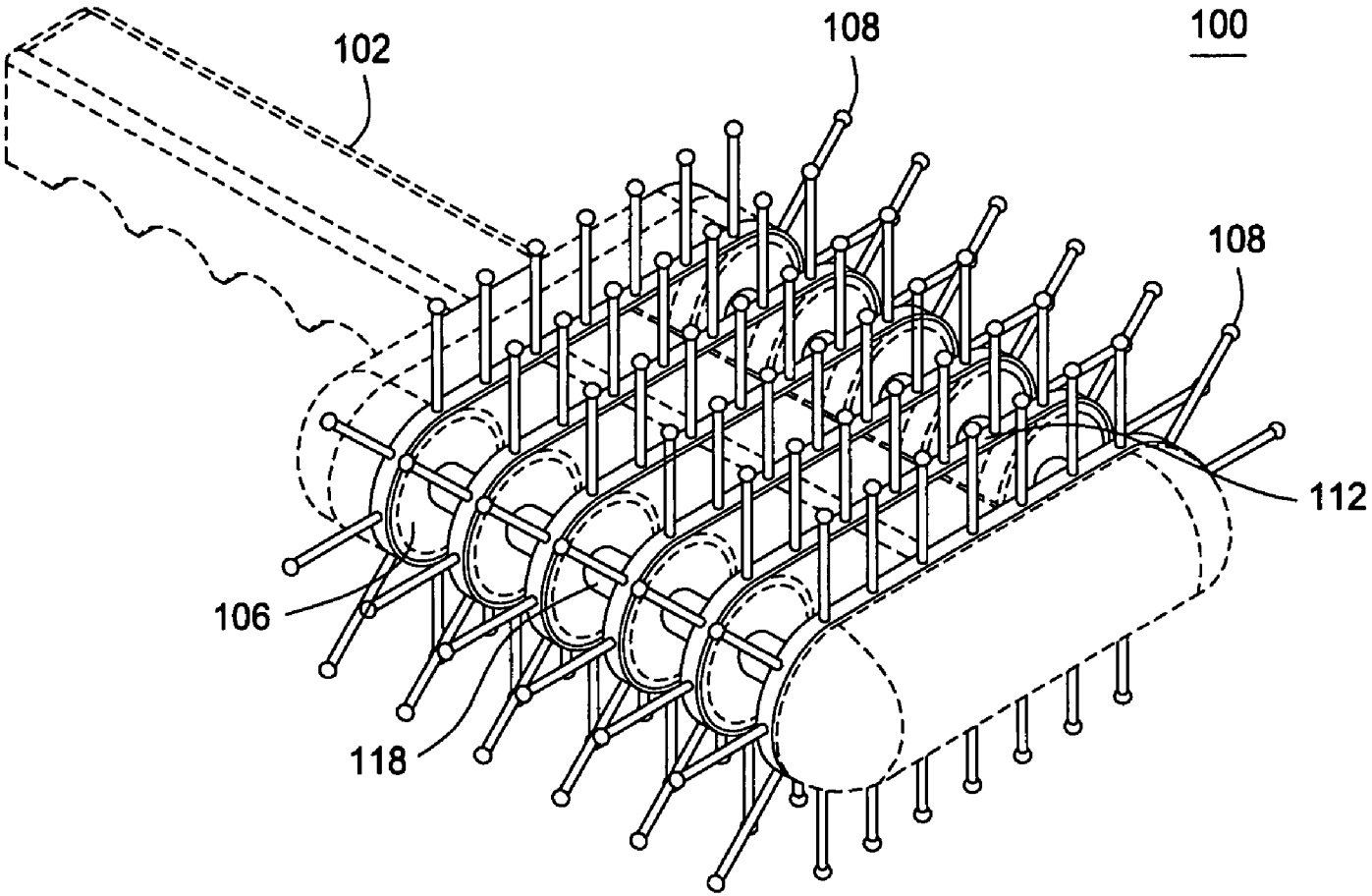
FIG. 2 is a perspective view of the hair brush with its cover partially removed.

FIG. 2 is a perspective view of the hair brush 100 with its cover partially removed. As shown in FIG. 2, the revolving track portions 112 are rotatable on tracks 106. The revolving track portions 112 during brushing can remain stationary until a tangle of hair is met by the bristles 108. As the user continues brushing, the revolving track portions 112 that do not meet the tangle of hair or other resistance by the hair (gum, dirt, etc.) remain stationary, while the revolving track portions that meet the tangle or other resistance can rotate in the opposite direction of the brushing.

Positioned between the tracks 106 are friction elements 118 that can engage the surface or surfaces of the tracks. As discussed below, the friction elements are designed to engage the tracks in order to provide resistance to the tracks' rotation during use.

Figure 3:
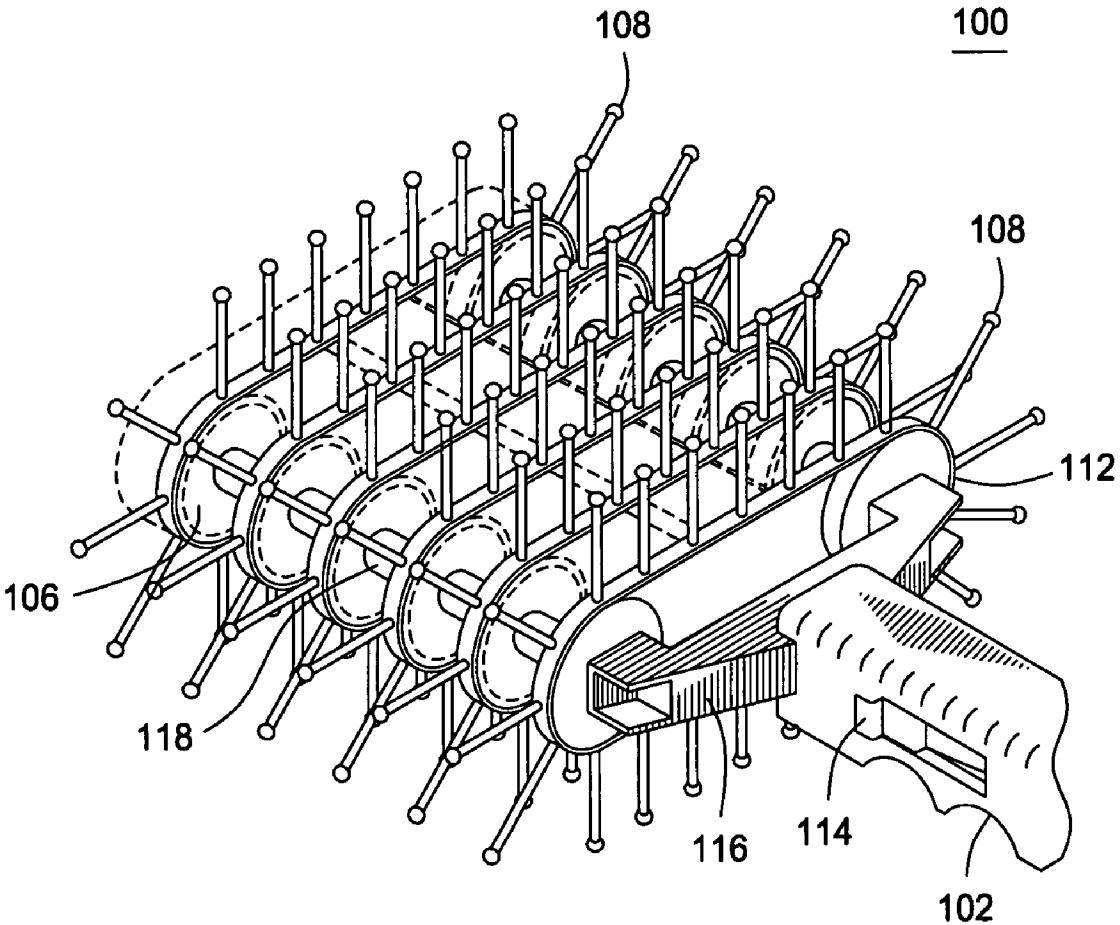
FIG. 3 is a perspective view of the hair brush showing a clutch assembly according to an embodiment of the invention.

FIG. 3 is a perspective view of the hair brush 100 showing a clutch assembly according to an embodiment of the invention. The handle portion 102 includes the thumb button 114 that is slidable along the handle portion. As shown below, when the thumb button 114 is moved in a first direction, there can be less resistant on the tracks 106 and thus, the revolving track portion 112 can rotate easily. Conversely, when the thumb button 114 is moved in a second direction, there can be more resistant and the revolving track portion 112 will rotate with greater resistance or even be in a "locked" position. The thumb button 114 is coupled to a clutch assembly that includes clutch tensioning arms 116 and friction elements 118. Shafts (not shown) are coupled or integrated with clutch tensioning arms 116 and extend from the arms 116. The shafts are received by the friction elements 118 and the tracks 106.

The clutch tensioning arms 116 are constructed and arranged to be responsive to the movements of the thumb button 114 and act on the tracks 106 in order for the tracks to engage the friction elements. The friction elements are positioned between a pair of tracks 106 in order to provide the necessary resistance to the rotation of the tracks, depending on the tension desired by the user. The friction elements may be made of any material, such as a synthetic resin, rubber, semi-metallic, metallic and other elements. The friction elements can include friction material on one side or both sides to engage one or both surfaces of the track depending on the needs of the user.

In operation, the user using the handle 102 moves the brush in one direction. Typically brushing from the top of the user's head to the bottom. Before the bristles encounter a tangle, the revolving track portions should not rotate. As noted above, the revolving track portions can rotate in conjunction with each other or independent of each other. The bristles 108 are mounted on the revolving track portions 112 allowing them to rotate away (or in the opposite direction of brushing) when the bristles come in contact with a tangle of hair or other resistance. Once the brush encounters a tangle of hair, the bristles and their respective revolving track portions that do not encounter tangles should not rotate and thus, the user can continue to brush the hair without having to stop and reposition the brush. Conversely, the bristles and their respective revolving track portions that encounter the tangles can rotate in their tracks in a direction opposite of the direction of brushing. Because the bristles are allowed to rotate in the direction opposite of the brushing upon reaching the tangle, this decreases the chance of pain that can be caused by brushing a tangle with a brush having fixed bristles. As the user continues to brush the hair through the tangle portion, the other bristles that did not rotate will continuously comb the hair or hairs from the tangle, thereby reducing the tangle's size, and leaving neatly brushed hair.

The rotation of the tracks can be adjusted by using the thumb button on the handle. By sliding the thumb button 114 in a first direction, less resistance is created and by sliding the thumb button in a second direction, more resistance is created. Sliding the thumb button 114 in the first direction, the clutch assembly is not engaged or minimally engaged and thus, the tracks 106 and the revolving track portions 112 rotate freely. As the thumb button is slid in the second direction, the resistance on the tracks 106 and the revolving track portions 112 increases. This is due to the response of the clutch tensioning arms 116 to the movement of the thumb button. As the thumb button is moved in the second direction, the clutch tensioning arms act on the nearest set of tracks pushing it closer to the friction element that is positioned between the nearest set of tracks and the next set of tracks. This causes a cascading effect, which causes similar resistance to the other set of tracks and their corresponding friction elements. As the clutch tensioning arms apply more force on the nearest set of tracks, then the friction elements are able to act on their respective set of tracks thereby decreasing their rotation. Thus, the bristles can be adjusted from being able to rotate freely to being locked in position.

By being able to adjust the resistance of the tracks and thus the revolving track portions, the bristles can rotate more for very tangled hair or rotate less as the hair starts to become less tangled. The resistant adjustable feature allows the user to adjust the resistance of the bristles depending on hair type and conditions of the hair.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A hair brush, comprising:

a handle portion to move the hair brush through hair;

a body portion coupled to the handle portion and having revolving track portions that rotate on a set of tracks, wherein each revolving track portion is independently connected to a track of the set of tracks;

sets of bristles coupled to the revolving track portions to brush hair, wherein one of the sets of bristles is independently coupled to one of the revolving track portions such that the sets of bristles are freely movable with respect to one another; and a slidable button that adjusts a resistance that is applied to the tracks through a clutch assembly and thereby adjusts the rotation of the revolving track portions.

2. The hair brush of claim 1, wherein the body portion further comprises non-revolving portions.

3. The hairbrush of claim 2, wherein the revolving track portions rotate independently of each other.

4. The hairbrush of claim 1, wherein the clutch assembly includes a friction element that applies the resistant to the tracks to decrease the rotation of the tracks.

5. The hairbrush of claim 1, wherein only those bristles of the revolving track portions that encounter a resistance in the hair will rotate in a direction opposite a direction of brushing.

6. The hairbrush of claim 1, wherein the slidable button can adjust the rotation of the revolving track portions from freely rotating to a fixed position.

7. The hair brush of claim 5, wherein the bristles on the revolving track portions that do not encounter the resistance in the hair will remain in a fixed position.

8. The hair brush of claim 1, wherein the bristles on the revolving track portions rotate when the bristles encounter a tangle of hair.

9. A hairbrush, comprising:

a handle portion to move the hair brush through hair;

a body portion coupled to the handle portion, wherein the body portion includes revolving track portions that rotate on a set of tracks and the body portion includes a non-revolving portion positioned between the revolving track portions;

a set of bristles coupled to the revolving track portion to brush hair, wherein one of the sets of bristles is independently coupled to one of the revolving track portions such that the sets of bristles are freely movable with respect to one another; and a slidable button that adjusts a rotation of the revolving track portion through a clutch assembly.

10. The hairbrush of claim 9, wherein the revolving track portions rotate independently of each other.

11. The hairbrush of claim 9, wherein the clutch assembly includes a friction element that applies the resistant to the tracks to decrease the rotation of the tracks.

12. The hairbrush of claim 9, wherein only those bristles of the revolving track portions that encounter a resistance in the hair will rotate in a direction opposite a direction of brushing.

13. The hairbrush of claim 9, wherein the slidable button can adjust the rotation of the revolving track portions from freely rotating to a fixed position.

14. The hair brush of claim 12, wherein the bristles on the revolving track portions that do not encounter the resistance in the hair will remain in a fixed position.

15. The hair brush of claim 9, wherein the bristles on the revolving track portions rotate when the bristles encounter a tangle of hair.

16. The hairbrush of claim 9, wherein the clutch assembly includes clutch tensioning arm and friction elements.

* * * * *